US007326072B2

(12) United States Patent
Lutsch et al.

(10) Patent No.: US 7,326,072 B2
(45) Date of Patent: Feb. 5, 2008

(54) CONNECTION ELEMENT FOR THE ELECTRICALLY CONDUCTIVE CONNECTION TO THE LAMP HOLDER OF A MAIN HEADLAMP

(75) Inventors: Harald Michael Lutsch, Weiterstadt (DE); Ranko Resman, Zagreb (HR); Vladimir Buden, Zagreb (HR); Vedran Mahovic, Samobor (HR); Hrvoje Lovko, Zagreb (HR)

(73) Assignee: Yazaki Europe Ltd., Hertfordshire (GB)

( * ) Notice: Subject to any disclaimer, the term of this patent is extended or adjusted under 35 U.S.C. 154(b) by 175 days.

(21) Appl. No.: 11/001,291

(22) Filed: Dec. 2, 2004

(65) Prior Publication Data

US 2005/0164556 A1 Jul. 28, 2005

(30) Foreign Application Priority Data

Jan. 27, 2004 (DE) ..... 10 2004 004 203

(51) Int. Cl.
*H01R 13/625* (2006.01)

(52) U.S. Cl. ..... 439/332; 439/918; 362/649; 362/651

(58) Field of Classification Search ..... 439/332, 439/341, 611, 918, 699.2, 226; 362/649–655
See application file for complete search history.

(56) References Cited

U.S. PATENT DOCUMENTS 4,764,854 A * 8/1988 Matsune et al. ..... 362/649
5,174,785 A * 12/1992 Endo et al. ..... 439/489
5,637,020 A * 6/1997 Ito ..... 439/699.2
5,876,251 A * 3/1999 Muta ..... 439/699.2
6,270,235 B1 * 8/2001 Coushaine ..... 362/645
6,467,942 B2 * 10/2002 Alloway et al. ..... 362/549
6,536,929 B1 * 3/2003 Forgacs et al. ..... 362/519
6,558,193 B2 * 5/2003 Sawayanagi et al. ..... 439/545
6,923,555 B2 * 8/2005 Byggmastar ..... 362/651

(Continued)

FOREIGN PATENT DOCUMENTS

DE 298 23 160 U1 4/1999

(Continued)

*Primary Examiner*—Briggitte Hammond
*Assistant Examiner*—Larisa Tsukerman
(74) *Attorney, Agent, or Firm*—Sughrue Mion, PLLC

(57) ABSTRACT

A connection element for electrically conductive connecting to two flat contact tabs, projecting radially from a lamp holder and offset along the axis and which wide sides extend transversally to the axis, connectable by a pivot movement around an axis to the socket of a lamp, especially a main headlamp of an automotive vehicle, comprising two contact elements 9 of an electrically conductive material and which, respectively, have two contact arms 12, 13, connected integrally at one end 14 to each other and formed yoke-like, so that their non-connected end portions are arranged opposite to each other and form contact portions 15, 16, serving for contacting a flat contact tab at both sides at its wide sides, have a connection contact portion 17, connected integrally to a contact arm 12 and projecting from the contact portions 15, 16 away from the connected end 14, a housing, which has a front end face and a side face arranged at an angle thereto, has for each contact element 9 an accommodation chamber, which has an opening towards the end face and a slot, which extends from the side face into the accommodation chamber and through an end wall forming the end face into the opening.

11 Claims, 8 Drawing Sheets

U.S. PATENT DOCUMENTS 6,962,308 B2 * 11/2005 Schwaerzler et al. ..... 244/149
6,976,776 B2 * 12/2005 Kakidaira et al. ..... 362/548
7,014,510 B2 * 3/2006 Powers et al. ..... 439/699.2
7,083,476 B2 * 8/2006 Helbig et al. ..... 439/699.2
7,097,343 B2 * 8/2006 Tiesler-Wittig et al. ..... 362/651
2003/0045151 A1 3/2003 Josquin et al.

FOREIGN PATENT DOCUMENTS

GB 2204749 * 12/1986

* cited by examiner

CONNECTION ELEMENT FOR THE ELECTRICALLY CONDUCTIVE CONNECTION TO THE LAMP HOLDER OF A MAIN HEADLAMP

BACKGROUND OF THE INVENTION

The invention relates to a connection element for the electrically conductive connection to flat contact tabs on a lamp holder of a lamp, which can be connected by a pivot movement around an axis with the socket of a lamp, especially of a main head-lamp of an automotive vehicle.

In an automotive vehicle many types of lamps are used, which differ from each other also in the form of their lamp holder and the arrangement and design of the contacts (see, for example, the book "Autoelektrik, Autoelektronik/Bosch" (automotive electrics and electronics/Bosch), third revised edition 1998, Publisher View eg, pages 222 to 227, as well as 234 and 235).

Lamp holders are also being developed, which can be connected by means of pivoting around an axis to a socket, in which, however, the flat contact tabs project radially in reference to the axis from the lamp holder.

It is an object of the invention, to provide a connection element for the electrically conductive connection to the flat contact tabs of a lamp holder, which project radially from the lamp holder, wherein the same can be mounted by a pivot movement at the socket.

SUMMARY OF THE INVENTION

The object is solved according to the invention by a connection element for electrically conductive connecting to two flat contact tabs, projecting radially from a lamp holder and offset along the axis and which wide sides extend transversally to the axis, connectable by a pivot movement around an axis to the socket of a lamp, especially a main headlamp of an automotive vehicle, comprising

- two contact elements of an electrically conductive material and which, respectively,
- have two contact arms, connected integrally at one end to each other and formed yoke-like, so that their non-connected end portions are arranged opposite to each other and form contact portions, serving for contacting a flat contact tab at both sides at its wide sides,
- have a connection contact portion, connected integrally to a contact arm and projecting from the contact portions away from the connected end,
- a housing, which
- has a front end face and a side face arranged at an angle thereto,
- has for each contact element an accommodation chamber, which has an opening towards the end face and a slot, which extends from the side face into the accommodation chamber and through an end wall forming the end face into the opening.

Of advantage in this embodiment compared to a known embodiment for lamps, which are connected by means of a pivot movement of their lamp holders around an axis to the socket of a lamp and in which for the electrically conductive connection with a connection element flat contact tabs project parallel to the axis from the lamp holder, is, that by means of the pivot movement of the lamp holder at the same time when a mechanical connection of the same with the socket is achieved, an electrically conductive connection of the flat contact tabs with the contact elements of the connection element is produced. Such an assembly is mainly selected when ex-changing a mounted lamp. In the manufacture of an automotive vehicle, lamps are often delivered already pre-assembled on the socket, to be able to transport the lamp in a protected manner and to be able to check its function (operation) before the assembly. In the assembly of the vehicle, for example, the main headlamp is initially mounted together with the lamp arranged in the lamp socket on the body. In the solution according to the invention a radial or tangential connection of the connection element, respectively, together with the flat contact tabs is, then, possible.

In an embodiment of the invention it is provided, that the opening, starting from the side face, is dimensioned correspondingly to the entry length of the flat contact tab into the accommodation chamber.

The solution according to the invention allows different embodiments. Thus, it is possible, to form the connection contact portion for a crimping connection to an electric conductor of a cable. For this, a crimping portion with crimping tabs can, for example, be provided. This means, that a cable is directly connected to the connection contact portion and, thus, also to the contact elements, which are accommodated then in the housing.

It is, however, possible, to form the connection contact portion as a contact pin, so that on these a connector, provided already on the cable, together with contact elements formed as female terminals can be connected. In this case, preferably, the contact pin is formed as a flat contact pin. As normally two contact elements are pro-vided, it is advantageous, when the flat contact pin with its wide sides extends transversally to the wide side of the contact arms, so that only one type of contact elements with flat contact pins for different arrangements has to be manufactured.

If the connection element is provided with contact elements, which are provided with flat contact pins, it is provided, that the housing has a hood portion, into which the contact pins project in a protected manner.

The housing may consist of several parts, wherein the end wall having the end face is formed by means of a lid. Thus, the assembly of the contact elements in the housing is simplified.

To be able to fix the connection element close to the socket, the housing is provided with holding means for connecting to a holder, which, for example, can form part of the socket.

To facilitate the insertion of the flat contact tabs into the contact elements, it is provided, that the contact portions of the contact arms extend away from each other laterally towards the slot and towards the opening starting from the portions contacting the flat contact tabs.

Preferably, it is, however, provided, that the contact portions of the contact arms, starting from their portions contacting the flat contact tabs, diverge from each other laterally towards the slot as well as away from the same.

BRIEF DESCRIPTION OF THE DRAWINGS

Preferred embodiments of the invention are schematically shown in the drawing in which.

DETAILED DESCRIPTION OF THE INVENTION

Figure 1:
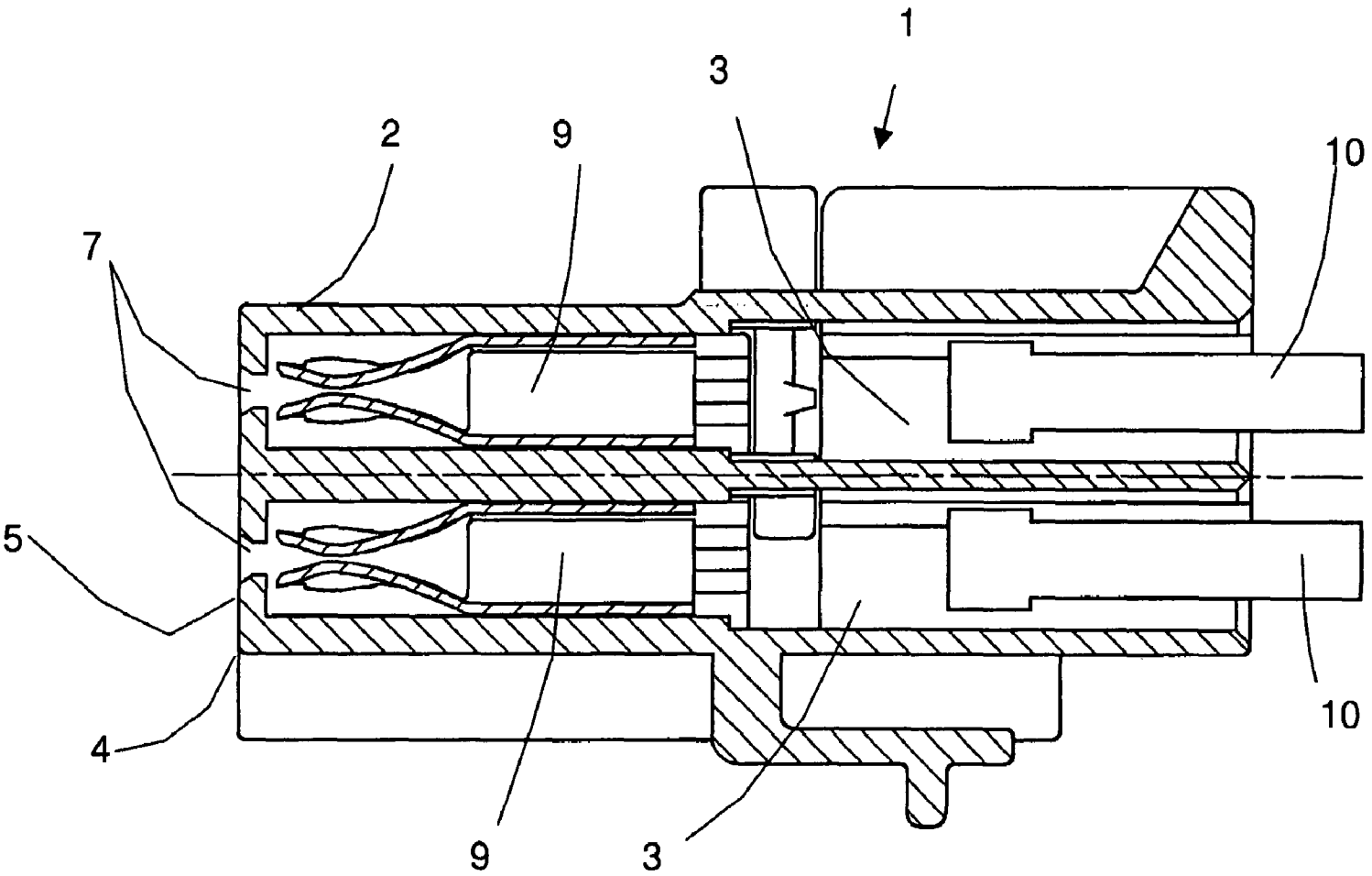
FIG. 1 is a longitudinal sectional view through a connection element according to the invention.
Figure 2:
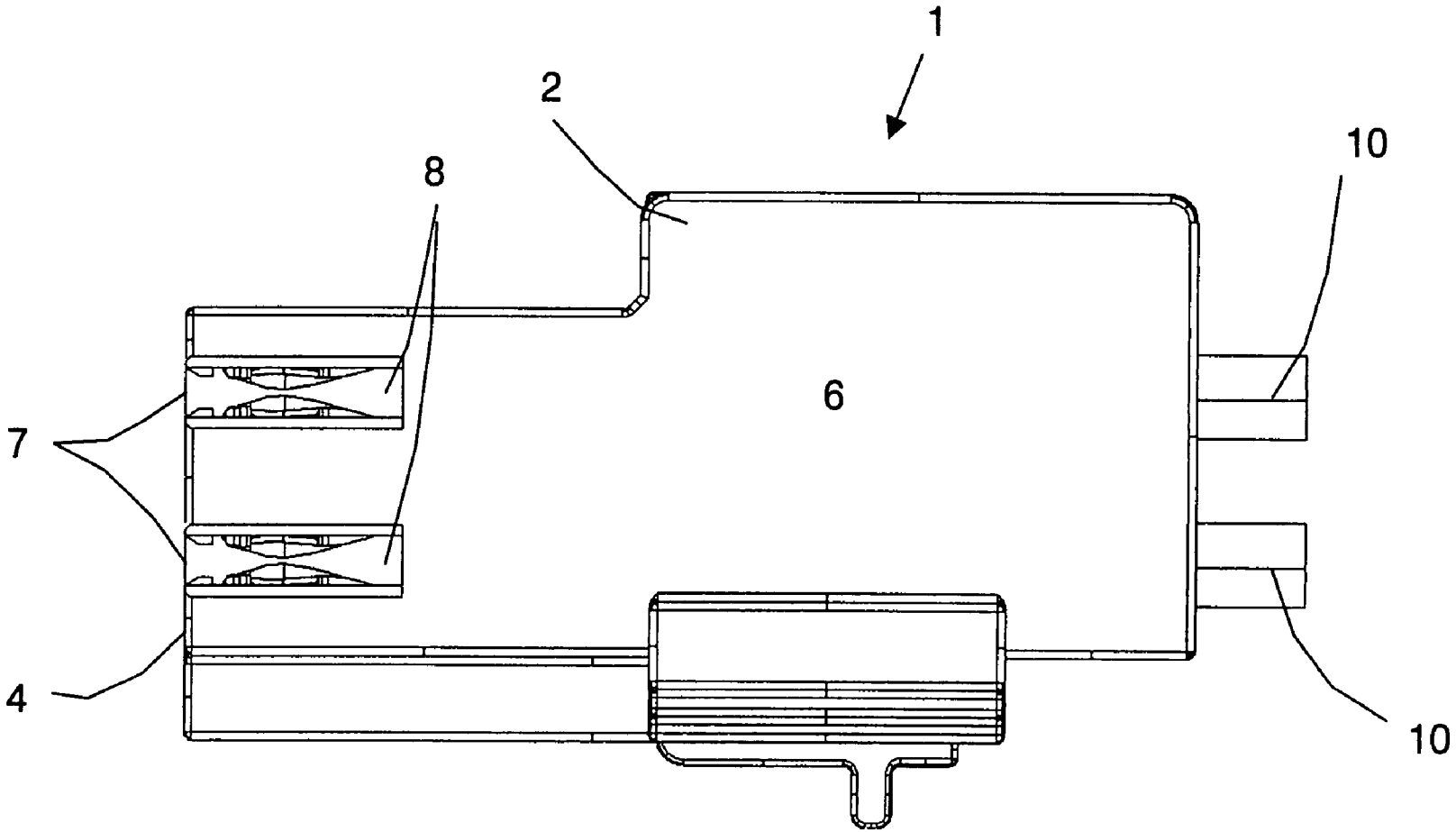
FIG. 2 is a side view of the connection element.
Figure 3:
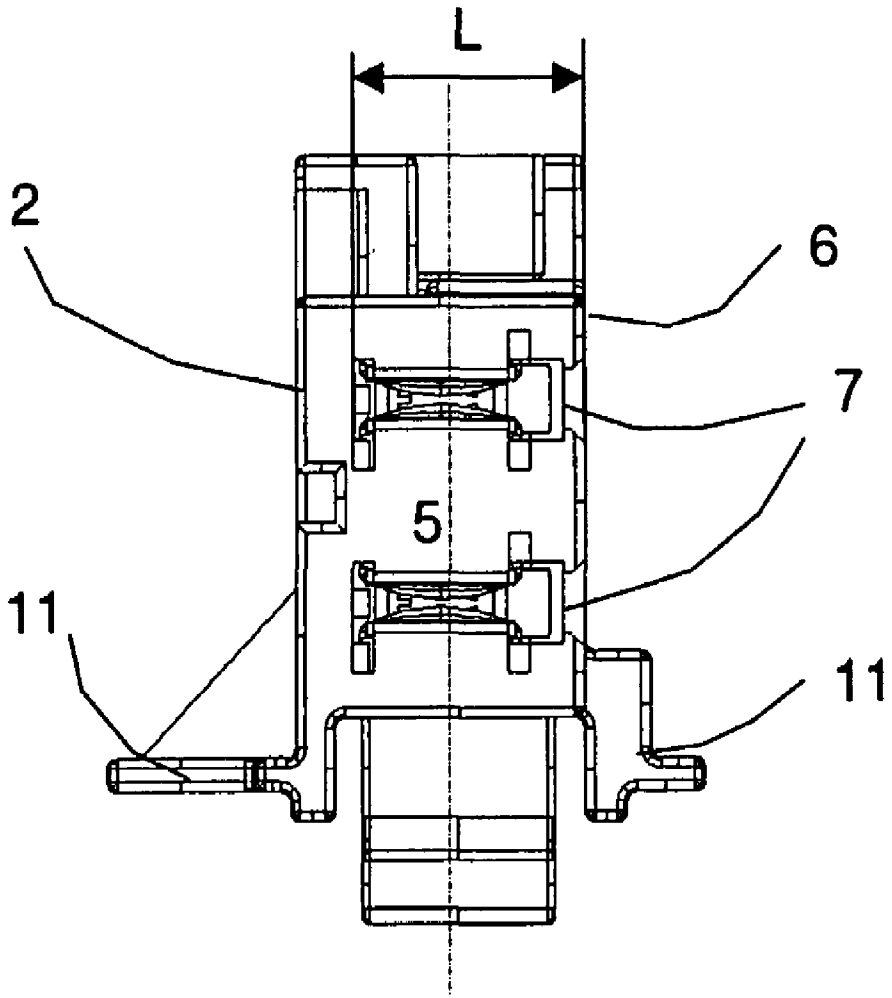
FIG. 3 is an end view onto the end face of the connection element in the direction of the arrow X of FIG. 2.

Firstly, a first embodiment of a connection element 1 is described by means of FIGS. 1 to 3. The connection element 1 comprises a housing 2, which has two accommodation chambers 3 extending in the longitudinal direction of the same, and which are arranged one on top of the other in FIG. 1. The housing 2 is closed to the front by an end wall 4, in which corresponding to the accommodation chambers 3, an opening 7 is, respectively, provided. Slots 8 extend in the side face 6 in longitudinal direction parallel to the accommodation chambers 3 up to the end face 5 and, therefore, also communicate with the openings 7. Therefore, two opening portions are achieved, which extend in the transversal direction starting from the side face 6 through the end wall 4 over a length L. In the accommodation chambers 3, respectively, a contact element 9 is arranged, which is, respectively, connected to a cable 10, which exits from the end of the housing 2, distanced to the end face 5. The two cables 10 serve for the current supply of, for example, the lamp of a main headlamp. The connection element 1 serves for providing an electrically conductive connection between the contact elements 9 and the flat contact tabs on the lamp holder of a lamp. Following, this is described in detail in connection with FIG. 5.

For retaining the connection element 1 attachment lugs 11 are provided on the same, which can be inserted into guides of a holder, which forms part of the socket or is mounted close thereto.

Figure 4:
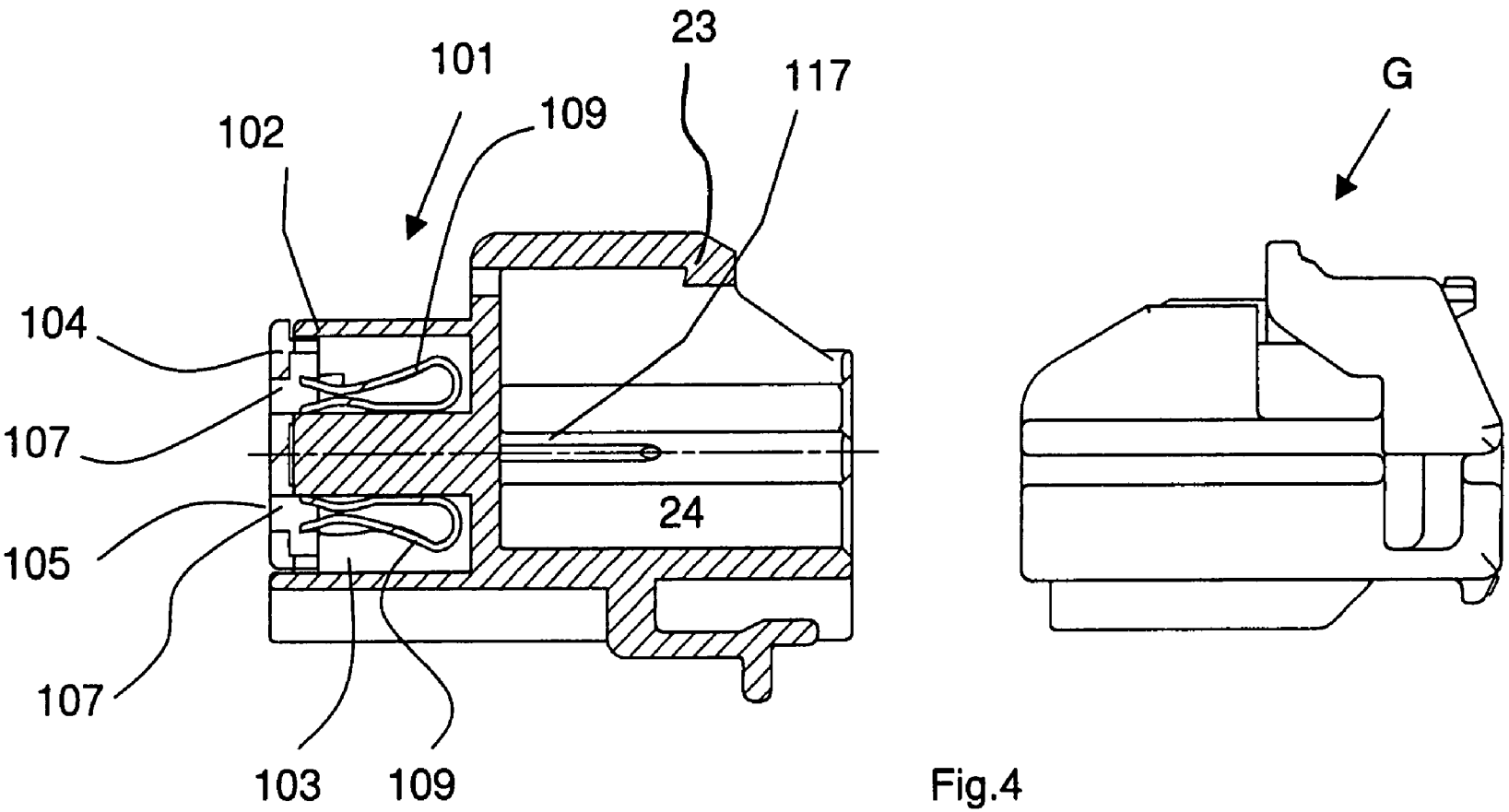
FIG. 4 is a longitudinal sectional view through a second embodiment of a connection element according to the invention.

While in the embodiment of FIGS. 1 to 3, the cable 10 is directly connected to the contact elements 9, the embodiment of the connection element 101 of FIG. 4 provides an interface with connection contact portions in form of connector pins 117, which are, respectively, connected to one contact element 109. The connection contact portions 117 can be connected to a mating connector G. In the connection element 101 of FIG. 4, a housing 102 is provided, which has a housing portion, which is essentially formed correspondingly to the housing 2 of FIGS. 1 to 3, wherein, however, the end wall with the end face 105 is represented by a separated lid 104. To this housing portion, a hood portion 23 is, however, connected, which forms for the insertion of the mating connector G an accommodation chamber 24, into which the connection con-tact portions 117 in form of flat connector pins, connected to the contact elements 109, project. The construction of the housing portion, accommodating the contact elements 109, corresponds to that of the embodiment of FIGS. 1 to 3, for which it is referred to the description of FIGS. 1 to 3. In FIG. 4 reference numerals are used, which for comparable elements in FIGS. 1 to 3 are increased by the numerical value 100. The views of FIGS. 2 and 3 are valid concerning the housing portion accommodating the contact elements 109 as well for the housing 102.

Concerning the description of these parts it is referred to FIGS. 1 to 3.

Figure 5:
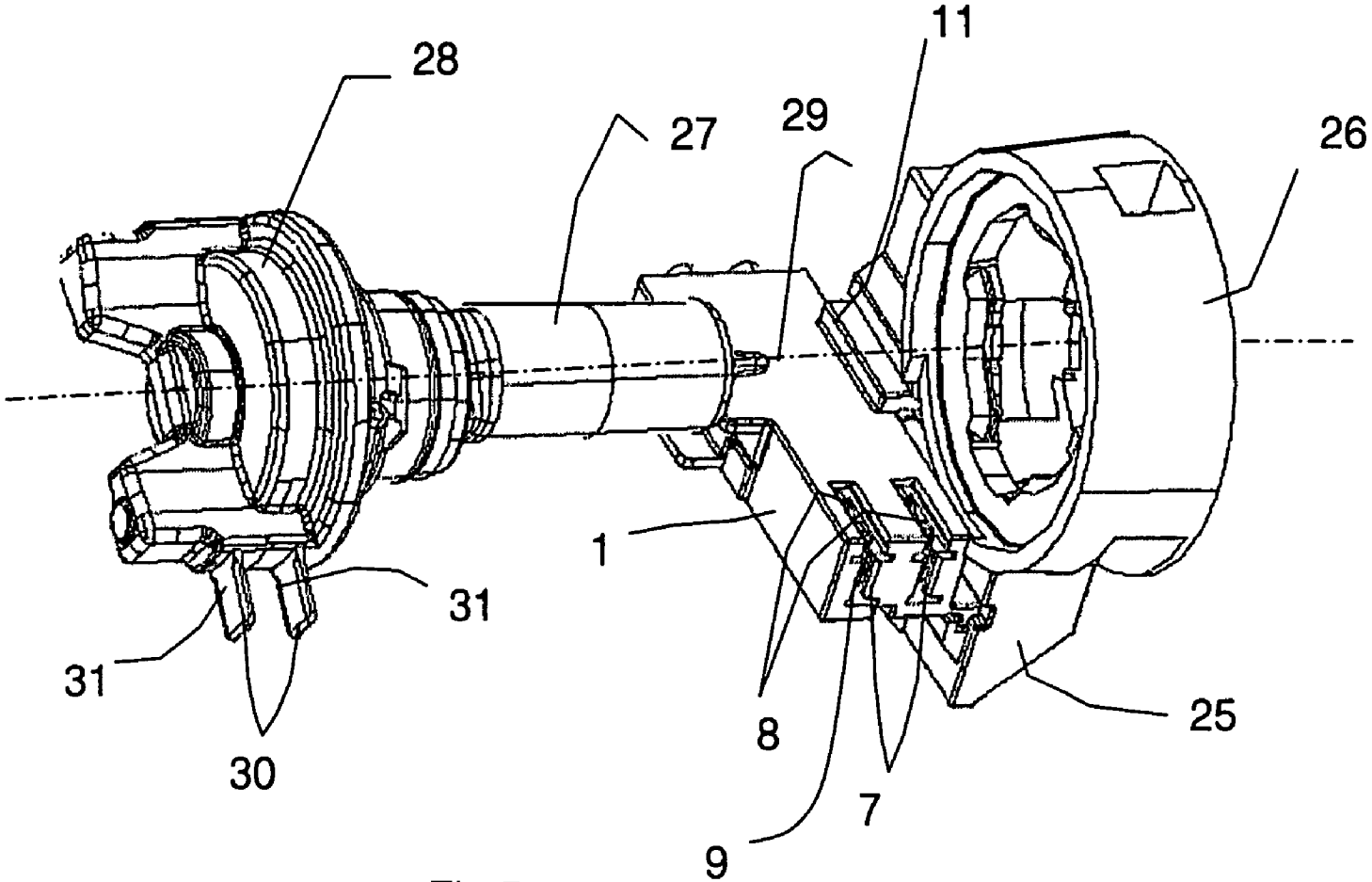
FIG. 5 is a perspective view of the arrangement of a connection element of FIGS. 1 to 3 to a lamp socket and a lamp accommodating the same.

FIG. 5 shows the arrangement of the connection element 1 of FIGS. 1 to 3 to a socket 26, onto which a holder 25 is formed. A lamp 27 can be inserted along the axis 29 into the socket 26. The lamp 27 is provided with a holder 28, from which flat contact tabs 30 project radially in reference to the axis 29. The flat contact tabs 30 are arranged off-set along the axis 29, wherein their wide sides 31 form parallel planes, on which the axis 29 is arranged at a right angle. The lamp 27 can be inserted with its lamp holder 28 into an opening of the socket 26 and is pivoted for the mechanical retainment on the same around the axis 29, wherein the flat contact tabs 30 move via the opening 7 also into the slot 8 and come to contact the contact elements 9 in the housing 2. To ensure this, as shown in FIG. 3, the length L of the slot-like opening 7 is dimensioned along the end face 5 starting from the side face 6 corresponding to the entry length of the flat contact tabs 30.

The connection element 1 is retained on the holder 25 by means of the attachment lugs 11. Two assembly variants are possible. In the first variant, which is commonly used also in the original assembly of a vehicle, the lamp 27 with its holder 28 is al-ready mounted on the socket 26. The electrical connection is made after the assembly of, for example, the main headlamp on the body of the vehicle such, that the connection element 1, connected to the cables 10, is attached radially or tangentially, respectively, on the holder 25, wherein the lamp holder 28 of the lamp 27 remains in the mounted position in relation to the socket 26. If such a vehicle is assembled and in use and a lamp 27 has to be replaced, the same can be detached by pivoting the lamp holder 28 in the socket 26 around the axis 29 as well from the socket 26 as also concerning the electric connection of the flat contact tabs 30, as these are brought out-off contact to the connection element 1 and the contact elements 9 arranged therein during the pivoting of the lamp holder 28. The mounting of a new lamp is achieved, correspondingly, in a reversed manner, i.e. the lamp holder 28 of a new lamp 27 is inserted into the lamp socket 28 along the axis 29 and is pivoted then in such a manner, that the flat contact tabs 30 are brought into engagement with the openings 7 or the slots 8, respectively, and, thus, can contact the non-visible contact elements 9, whereby also an electric connection is achieved. The embodiment, thus, enables, that at the same time by means of the pivot movement of the lamp holder 28 a mechanical connection to the lamp socket 26 as well as an electric connection to the contact elements of the connection element 1 are achieved.

In the same manner as described in connection with FIG. 5 a connection of the connection element 101 of FIG. 4 can also be produced, wherein cables already provided with mating connectors can be connected to a connection element according to the invention.

Figure 6:
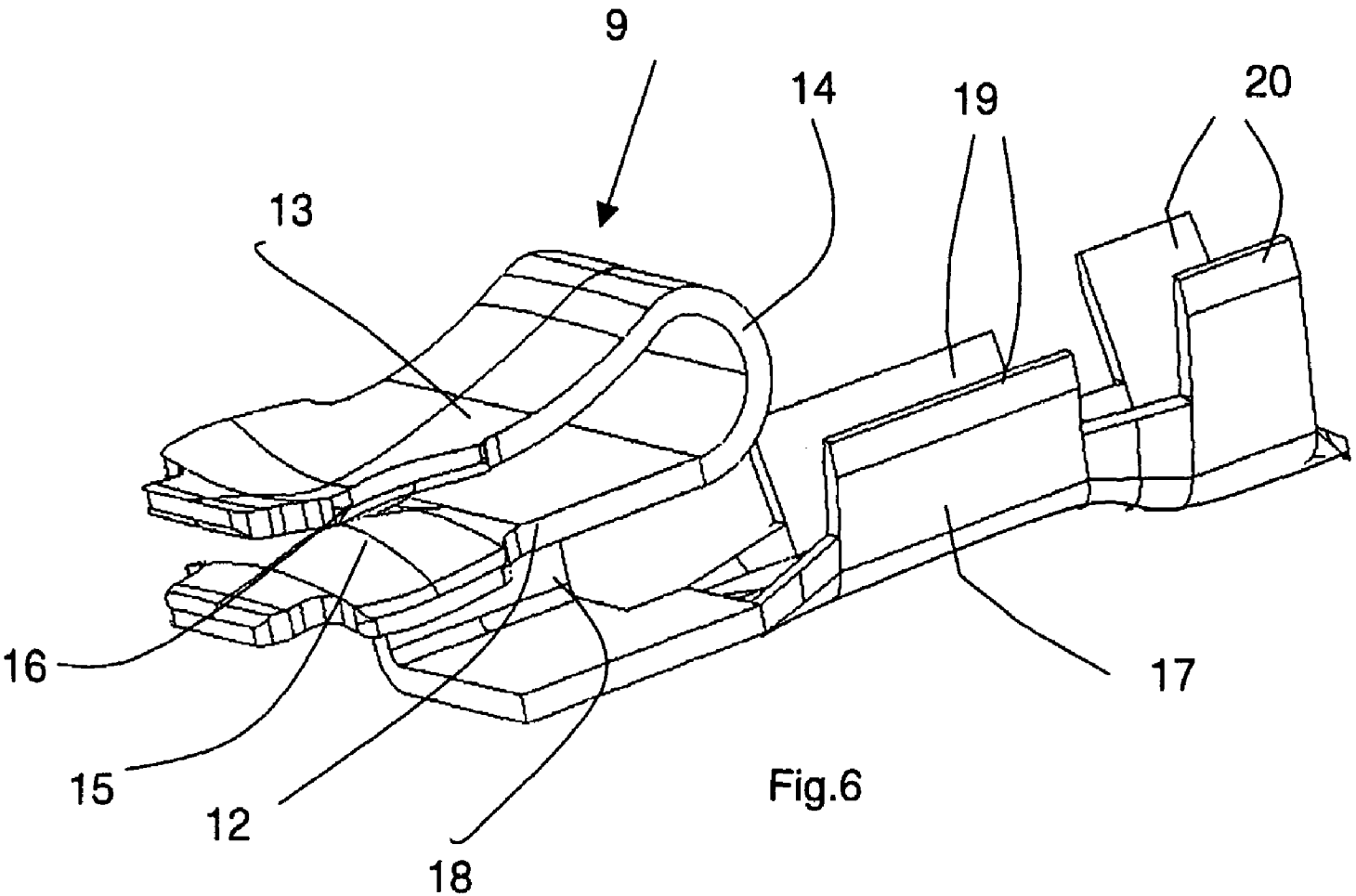
FIG. 6 a perspective view of a contact element in a first embodiment according to the invention fitting to the connection element of FIGS. 1 to 3.

The contact elements 9, 108, used in the two different embodiments of FIGS. 1 to 3 on the one hand and of FIG. 4 on the other hand, are described in more detail in the following in reference to FIGS. 6 to 8, wherein FIG. 6 is a perspective representation of a contact element 9 for the embodiment of a connection element 1 of FIGS. 1 to 3.

In FIG. 6 a contact element 9 is visible, which comprises a first contact arm 12 and a second contact arm 13, extending from a connected end 14 and form at their free ends a first contact portion 15 or a second contact portion 16, respectively, wherein the contact portions 15, 16 of the two contact arms 12 or 13, respectively, are arranged opposite each other and serve, respectively, for accommodating a flat contact tab 30 of FIG. 5 between each other and to electrically contact the same. To the first contact arm 12 is connected in a bent manner an intermediate portion 18, to which a connection contact portion 17 in form of a crimping connection is connected, serving to provide an electrically conductive connection to the conductor of the cable 10, for which conductor crimping tabs 19 forming a pair and arranged opposite to each other, are provided, which are crimped to the conductor of the cable 10. Furthermore, two insulation crimping tabs 20 arranged opposite each other, are arranged on the U-like connection contact portion 17. These accommodate the insulation of the cable 10 between each other and are pressed against the same, to hold the cable 10.

Towards the free end, i.e. away from the connected end 14 of the two contact arms 12, 13, the two contact portions 15, 16 diverge from each other. The same is valid in a direction transversally thereto, so that a concentrated contact portion, arranged approximately centred, is achieved. The portions diverging from each other form insertion funnels, which serve to facilitate the connection or pivoting-in of the flat contact tabs between the first contact arm 12 and the second contact arm 13, so that these during continued pivoting are moved away from each other and can slide on to the wide sides 31 of the flat contact tabs 30 of FIG. 5.

Figure 7:
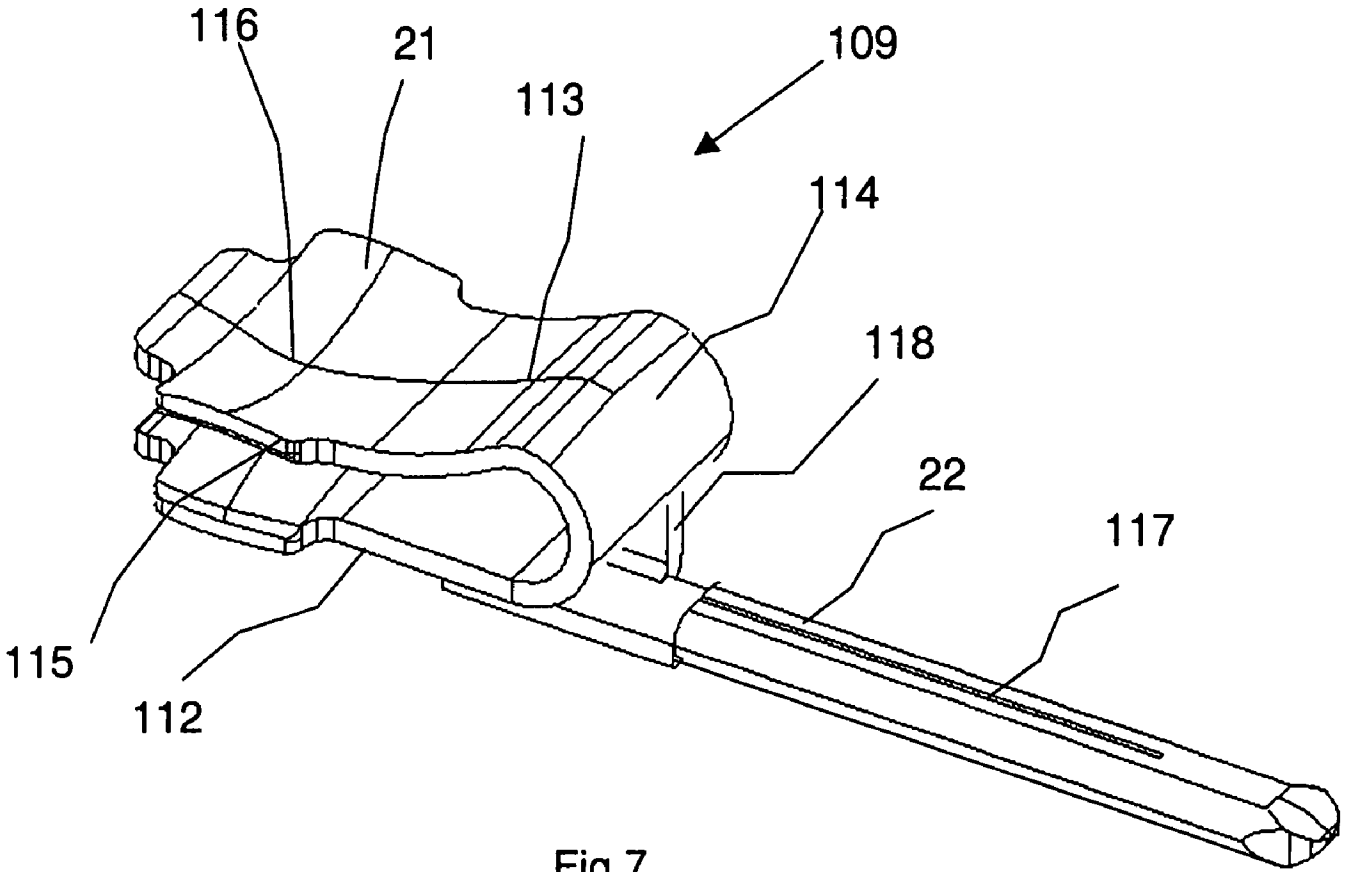
FIG. 7 is a perspective view of the mating arrangement of two connection elements in an embodiment, which fits to the connection element of FIG. 4.
Figure 8:
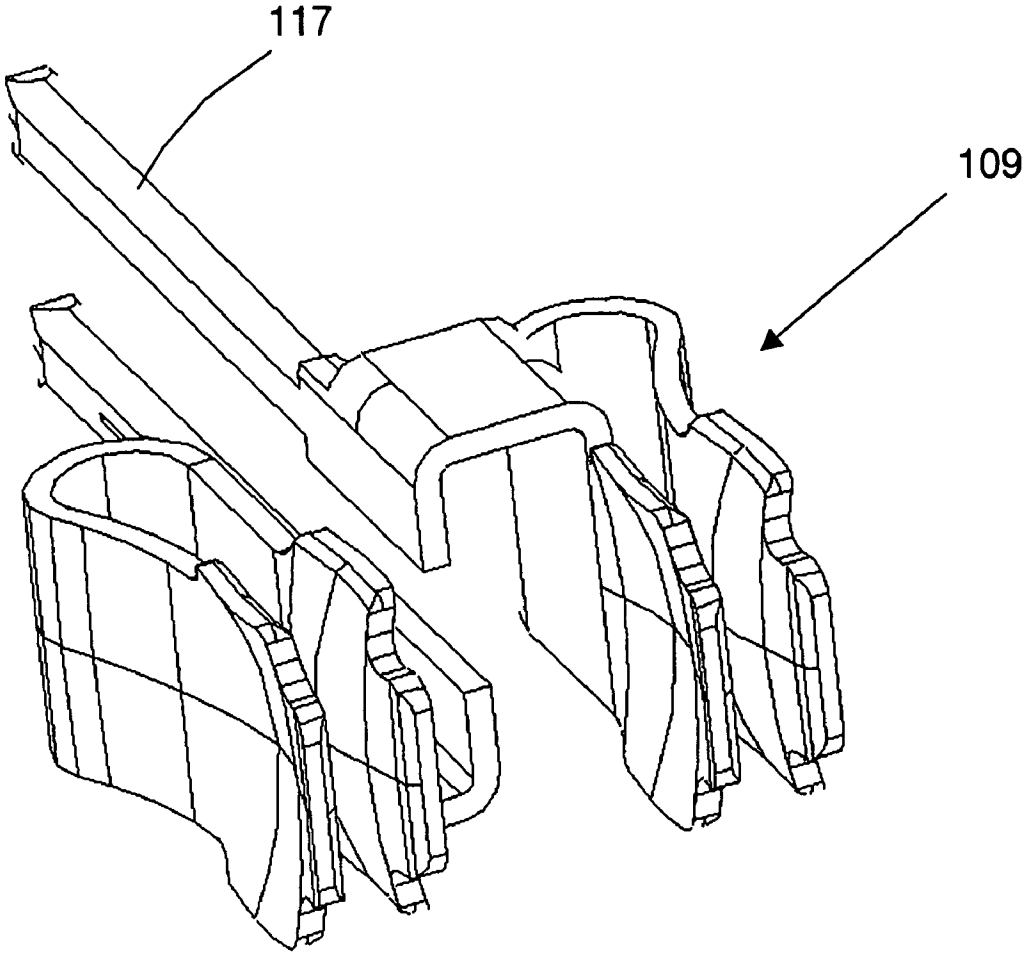
FIG. 8 is a perspective view of the mating arrangement of two connection elements of FIG. 7 in a viewing direction, changed compared to that of FIG. 7.

FIGS. 7 and 8 show a second embodiment of contact elements 109, which are determined to be used with the connection elements 101 of FIG. 4. In this case, the first contact arm 112 and the second contact arm 113 are also connected as in the embodiment of FIG. 6 at an end 114 and form, respectively, a first contact portion 115 and a second contact portion 116. The intermediate portion 118 connected integrally to the first contact arm 112 is followed by a connection contact portion 117 in form of a flat connector pin, which wide sides 22 are aligned in parallel to the wide side 21, for example of the second contact arm 113. Otherwise, the design of the contact arms 112, 113 corresponds to that of the first embodiment of FIG. 6, for what it is referred to the description of FIG. 6, wherein parts, corresponding to those of FIG. 6, are provided with reference numerals, which are increased by the numerical value 100 compared to those of FIG. 6.

The embodiment of FIG. 7 enables, as shown in FIG. 8, a mating arrangement of two contact elements 109, in which the connection contact portions 117 in form of flat connector pins are arranged side by side.

What is claimed is:

1. A connection element, comprising two contact elements of an electrically conductive material and which, respectively, have two contact arms, connected integrally at one end to each other and formed yoke-like, so that their non-connected end portions are arranged opposite to each other and form contact portions, serving for contacting a flat contact tab at both sides at its wide sides, have a connection contact portion, connected integrally to a contact arm and projecting from the contact portions away from the connected end, a housing, which has a front end face and a side face arranged at an angle thereto, has for each contact element an accommodation chamber, which has an opening towards the front end face and a slot which extends from the side face into the accommodation chamber and through an end wall forming the front end face into the opening, wherein the two contact elements are capable of connecting to two flat contact tabs projecting radially from a lamp holder and offset along the axis and which wide sides extend transversally to the axis, and wherein the lamp holder is connectable, by a pivot movement around an axis, to the socket of a lamp.

2. Connection element according to claim 1, wherein the opening, starting from the side face, is dimensioned correspondingly to the entry length of the flat contact tab into the accommodation chamber.

3. Connection element according to claim 1, wherein the connection contact portion is formed for a crimping connection to an electric conductor of a cable.

4. Connection element according to claim 1, wherein the connection contact portion is formed as a contact pin.

5. Connection element according to claim 4, wherein the contact pin is a flat contact pin.

6. Connection element according to claim 5, wherein the flat contact pin with its wide sides extends transversally to the wide sides of the contact arms.

7. Connection element according to claim 4, wherein the housing has a hood portion, into which the contact pins project.

8. Connection element according to claim 1, wherein the housing is formed of several parts and the end wall, having the end face, is formed by a lid.

9. Connection element according to claim 1, wherein the housing has holding means for the connection to a holder.

10. Connection element according to claim 1, wherein the contact portions of the contact arms extend away from each other laterally towards the slot and towards the opening starting from their portions contacting the flat contact tabs.

11. Connection element according to claim 9, wherein the contact portions of the contact arms diverge from each other, starting from their portions contacting the flat contact tabs laterally towards the slot and away from the same.

* * * * *